United States Patent [19]

Zampini, Jr. et al.

[11] 4,083,448

[45] Apr. 11, 1978

[54] WALL PLATE PACKAGE WITH WAX SCREW SOCKET

[75] Inventors: Louis Zampini, Jr., Providence; Joseph P. Stefani, Warwick, both of R.I.

[73] Assignee: General Electric Company, New York, N.Y.

[21] Appl. No.: 591,226

[22] Filed: Jun. 27, 1975

[51] Int. Cl.[2] ..... B65D 73/02

[52] U.S. Cl. ..... 206/329; 206/347; 206/460; 206/488

[58] Field of Search ..... 206/231, 488, 486, 460, 206/321, 329, 347, 338

[56] References Cited

U.S. PATENT DOCUMENTS

| | | | |
|---|---|---|---|
| 1,946,808 | 2/1934 | Peirce | 206/231 |
| 1,953,062 | 4/1934 | Conway | 206/231 |
| 2,005,879 | 6/1935 | Albright | 206/460 X |
| 2,230,719 | 2/1941 | Guild | 206/231 |
| 2,599,011 | 6/1952 | Phipard, Jr. | 206/231 |
| 2,689,645 | 9/1954 | Greene, Jr. | 206/460 X |
| 3,135,384 | 6/1964 | Cozzolino | 206/488 X |
| 3,184,059 | 5/1965 | Kaplan | 206/329 |
| 3,812,961 | 5/1974 | Merrick et al. | 206/338 |

*Primary Examiner*—George E. Lowrance
*Assistant Examiner*—Joseph Man-Fu Moy
*Attorney, Agent, or Firm*—Paul E. Rochford; Walter C. Bernkopf

[57] ABSTRACT

A packaged article having a screw extending through the article is provided. The article packaged may be any article having a screw opening through it and having a screw for mounting the article into its normal place of use. In the package article of this invention the screw extends through the article and into a package to hold the article to the package. The package has a hole for receiving the screw and in this invention has also a threaded nut of polymer or pitch material bonded to the package. A method of forming a packaged article is also taught.

3 Claims, 14 Drawing Figures

WALL PLATE PACKAGE WITH WAX SCREW SOCKET

BACKGROUND OF THE INVENTION

Packaged articles have been known in which an article is held to a card package or the like by an attachment screw or the like. For example, wall plates for switches, receptacles, and other in-wall electrical installations have screws which are supplied with the wall plate and these screws are employed in installing the wall plate in place over an electric box mounted in a building wall. The screws are frequently supplied loose in the package or in a small plastic bag. Frequently the screw or screws are lost in transit or while the article is on display. In other cases, the screws may lodge between the wall plate and card so that the purchaser is not sure if the needed screws are actually in the package.

To overcome these deficiencies and to permit the prospective purchaser to see the wall plate as it appears with the screws in place in the mounting screw holes, a number of schemes have been developed to hold the screws in place as the article is displayed for sale. One such scheme was a heavier than necessary card backing and depends on holding the screw threads in this thicker card.

Another scheme employs a cardboard or similar washer to be placed around the threaded end of the screw and to slide along the screw shank to make it taught relative to the wall plate and card package. One problem of this construction is that it leaves the threaded end of the screw free in the sense of protruding from the rear of the packaged article. A problem which results when the packages are mounted on a pegboard is that the free end of the screw causes scratches on the surface of the next wall plate behind.

A different scheme involves mounting a plastic or paper collar over the free end of the screw. A difficulty with this construction is the difficulty of mounting the collar in the first place and then the difficulty of getting the collar off once the packaged article has been purchased and taken home for installation. The collar rotates with the screw so it cannot be removed by unscrewing unless it is tightly held. To hold it sufficiently tightly, most frequently requires a tool such as a pair of pliers and accordingly complicates the installation.

OBJECTS OF THE INVENTION

It is accordingly one object of this invention to provide a novel packaged article.

Another object is to provide a novel method of forming a novel packaged article.

Another object is to provide a package which protects adjoining packages.

Another object is to provide a packaged article of low assembly cost.

Another object is to provide a low cost package.

Still another object is to provide a reliable packaging method ensuring supply of screws with a screw containing packaged article.

Other objects and advantages of the invention will be in part apparent and in part pointed out hereinafter.

SUMMARY OF THE INVENTION

A novel packaged article is provided having an article mounted to a card package. The article is one which is mounted with screws in its end use application. The screws are employed in packaging the article in mounting the article to a card package. The card package is provided with holes aligned with holes of the article. A plastic nut is formed on the end of the screw protruding through the card package and the nut is bonded adherently to the reverse side of the card.

The method of forming the package includes the steps of depositing molten plastic into a form, depositing a card on the surface of the form, mounting an article over the card, and inserting a screw through the article and the card beneath to enter the molten plastic. With the screw in place, the molten plastic adheres to the card and forms a threaded nut about the end threads of the screw.

BRIEF DESCRIPTION OF THE DRAWINGS

In the description which follows, greater clarity of understanding will be gained by reference to the attached drawings in which.

DESCRIPTION OF A PREFERRED EMBODIMENT

Figure 1:
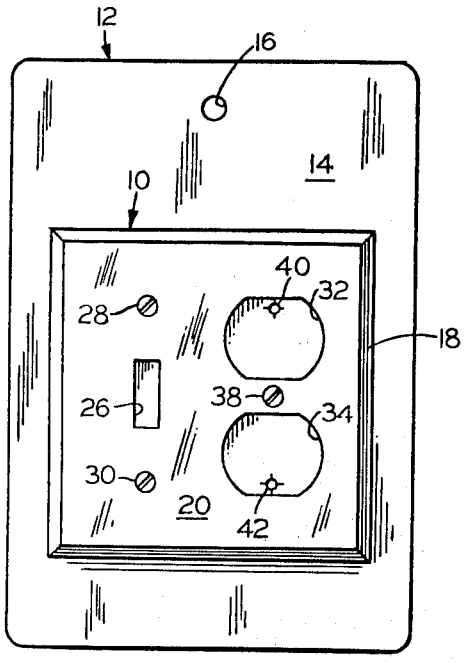
FIG. 1 is a front elevational view of a packaged article as provided pursuant to this invention.
Figure 2:
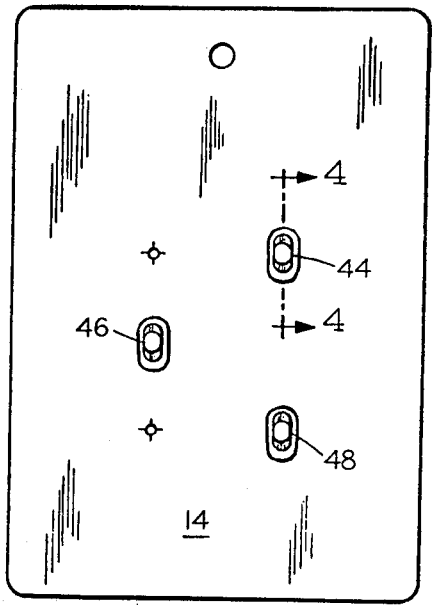
FIG. 2 is a rear elevational view of the packaged article of FIG. 1.
Figure 3:
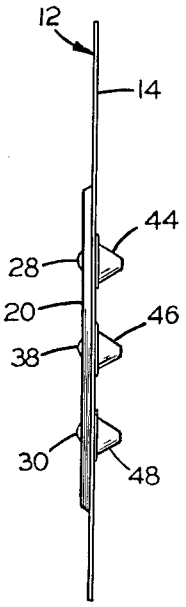
FIG. 3 is a side elevational view of the packaged article of FIG. 1.

Referring now to the drawings, a packaged article is illustrated in FIGS. 1 through 4 and 14, and the manner of arriving at this packaged article construction is illustrated in FIGS. 5 through 13.

The article itself is illustratively shown as a wall plate, but may conveniently be any article which is mounted in its end use with a mounting screw and which accordingly is furnished with a mounting screw.

In the illustrative case shown, the particular wall plate is one for a combination of a wall switch and a wall receptacle. Normally, such a wall plate 10 is mounted on a card package 12. The card may be provided with an area 14 extending beyond the article 10 and this area may contain advertising or other informative printed matter as well as a hole 16 for mounting the card onto a peg of a conventional pegboard (not shown). When mounted on a peg the packaged articles touch the rear of one to the front of that behind. In such mounting protruding screws can score or scratch or otherwise mar the decorative face of the next wall plate on the peg. Such marring is prevented pursuant to this invention as hereinafter described.

The wall plate 10 is itself made up in the illustrative case shown of a beveled edge portion 18 and a decorative land area 20. The left half of the plate 10 is for covering a switch and has for this purpose two screw holes and a trigger opening 26. The screw holes are not evident in FIG. 1 as they are occupied by screws 28 and 30.

The right half of the plate 10 is for covering a wall receptacle and is for this purpose provided with the receptacle openings 32 and 34 as well as with a screw hole therebetween occupied in the view of FIG. 1 by screw 38.

Two openings 40 and 42 in card 12 are seen through receptacle openings 32 and 34. These are the normal screw openings through the card and are characterized by a small round center opening and four slots extending radially from the center opening. The card portion between the slots constitutes tabs which can be bent back from the card as a screw is inserted through the smaller center hole.

The threaded ends of the screws 28, 30, and 38 are protected pursuant to this invention by sheaths or nuts 44, 48, and 46 respectively. One such nut 44 is shown in detail in FIG. 4. The nut is plastic or wax in composition and is formed directly about the threads 50 of screw 28. The plastic nut is in fact itself internally threaded as it is formed directly about the threads of the screw 28 from a molten state as more fully explained below.

Also, the plastic nut is affixed to the back side of card package 12, the face of the card being that facing the packaged article 10. The adherence of nut 46 to card 12 occurs along the interface 52 between the card and nut. This interface 52 may extend beyond the main body of nut 46 to include the flash 54 and 56 above and below nut 46 respectively. The flash is formed as excess molten wax is squeezed out from nut 46 as the nut is formed from the molten state.

Figure 5:
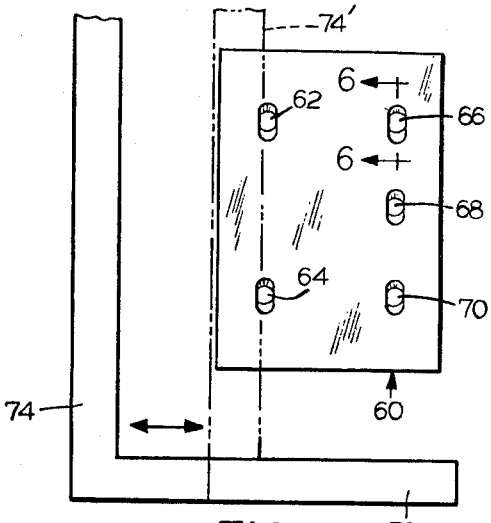
FIG. 5 is a top plan view of an assembly platform on which the packaged article may be formed.

The method of forming the packaged article of this invention is now described with greater particularity. In FIG. 5 a platform 60 is illustrated in a generally rectangular form. The platform is preferably a metal plate of sufficient thickness to have several cavities of appreciable depth formed in its face. These cavities are illustrated in the plan view of FIG. 5 and one, 66, is illustrated in the detailed fragmentary sectional view of FIG. 6. As is evident the cavities 62, 64, 66, 68, and 70 are arrayed in a generally rectangular pattern which matches the location of the screw holes in the card such as 12. The cavity location can be used with a card such as 12 and a card such as 12 can be used in packaging a combination wall plate such as 10 illustrated in FIG. 1. This same card and matching set of cavities in plate 60 can also be employed in mounting a double gang switch plate. In such case, the four corner cavities are used to install four screws in the four corner positions 62, 64, 66, and 70.

Figure 4:
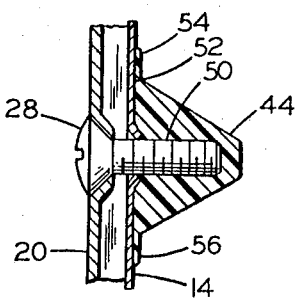
FIG. 4 is a detailed fragmentary view of the packaged article as seen in FIG. 3 with part shown in section.
Figure 6:
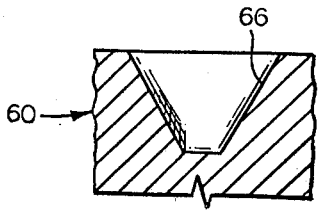
FIG. 6 is a sectional view of a cavity in the platform of FIG. 5 taken along the line 6—6 of FIG. 5.
Figure 7:
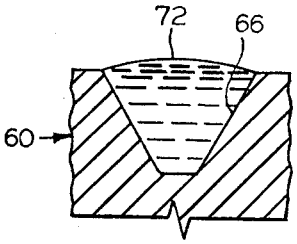
FIG. 7 is a similar sectional view of the cavity of FIG. 6 but filled with a molten plastic.

Referring now to FIG. 6, it is evident that cavity 66 has the general contour of the truncated pyramid of FIG. 4. In fact, the nut 46 is formed by deposit of molten plastic into cavity 66 and permitting it to solidify in the cavity. Such filling of a cavity such as 66 with a molten plastic 72 is illustrated in FIG. 7.

In FIG. 5, the platform has in addition to the array of cavities conforming to location of screw holes in a card package such as 12 a set of movable jigs. These jigs include a vertical jig 74 and a horizontal jig 76 which jigs serve as guides in placement of a card package so that the screw holes will be aligned with the cavities in platform base 60. Where a combination switch and receptacle plate or a two-gang switch plate is to be packaged, the card jig 74, 76 can be placed as shown in solid lines in FIG. 5. Where by contrast a single gang switch plate is to be packaged, the vertical jig 74 may be moved to the position of jig 74 to permit the screw holes of the smaller card to be properly located over the respective cavities.

Accordingly, in carrying out the present method, the first step is that of providing a platform base and providing wax receiving cavities in the base. The next step is that of filling the cavities with the nut-forming wax or other molten plastic or pitch-like material. Any material which melts and can be easily poured or inserted into the cavities and which will readily solidify with moderate cooling will work satisfactorily if it will both adhere to the card package and also separate from the screw inserted into the molten material during the assembly process. The screw must be removable by unscrewing motion. That is, the screw is turned counter-clockwise and must back itself out from the combined wax nut and card package. Low adherence of the wax nut to the screw threads is desirable for this reason.

After the cavities are filled with molten wax and the card has been accurately placed on the platform with the aid of the jig, the article to be packaged is placed over the card and is jigged into place. Accurate location of the article — in this case illustratively designated as a switch plate — is accomplished with the jig illustrated in the perspective view of FIG. 8.

Figure 8:
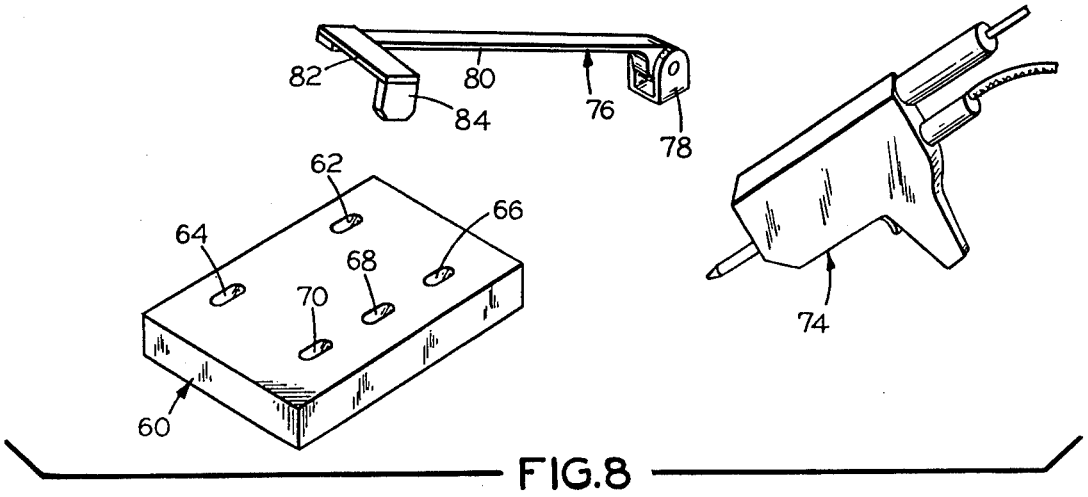
FIG. 8 is a perspective view of the platform of FIG. 5 with accessory jigging arm and wax gun.

In FIG. 8 the platform is illustrated at the left with its array of cavities. To the right of the figure is a conventional glue gun or wax gun 74 suitable for filling the selected cavities of the platform. The card jig is also present, but is not illustrated in order to keep the figure uncomplicated. Above the platform, a pivoting arm 76 is shown. This arm pivots about a fulcrum base 78. An arm 80 extending from the pivot point supports a side arm 82 and the side arm in turn supports a trigger form 84. The trigger form is a jig in that it conforms to the standard trigger opening of a switch plate, but is tapered at its lower portion to "find" a trigger opening and bring it into alignment and to bring its screw holes into alignment with the cavities 66 and 70 of the platform 60, and in turn of course with the appropriate openings of a card package which had already been jigged into place.

An outline is given of the several steps of the packaging method of this invention referring for this purpose to the set of schematic FIGS. 9 through 14.

Figure 9:
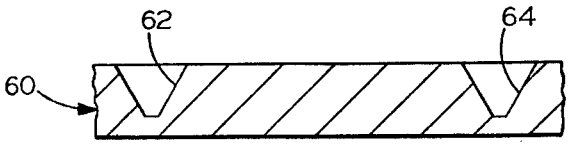
FIG. 9 is a schematic sectional view of the platform of FIG. 5 showing two empty wax cavities.

In FIG. 9 there is shown schematically a fragmentary view of a platform 60 and two cavities 64 and 62.

Figure 10:
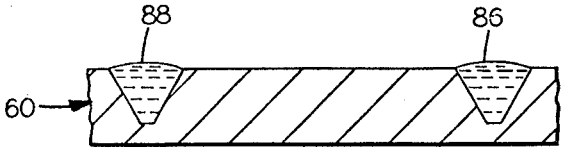
FIG. 10 is a schematic view similar to FIG. 9, but showing the cavities full.

In FIG. 10 the cavities illustrated to be empty in FIG. 9 are shown filled with a molten plastic or wax or pitch-like material 86 and 88. In fact the cavities are illustrated slightly overfilled so that any card placed on the platform will contact the molten wax-like material.

Figure 11:
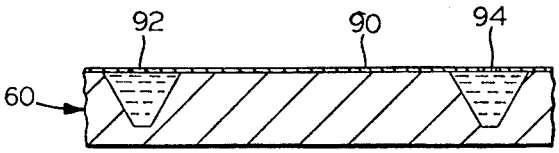
FIG. 11 is a similar schematic view with a card package laid in place.

In FIG. 11 a card 90 has been placed on the platform. The card 90 has screw holes 92 and 94 which are aligned with the cavities 62 and 64 and with the wax-like material 88 and 86 in the cavities.

Figure 12:
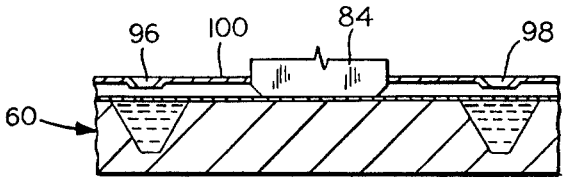
FIG. 12 is a similar schematic view with an article disposed on the card.

In FIG. 12 a switch plate 100 has been disposed over and onto the card 90. Switch plate 100 has screw holes 96 and 98. Also, the trigger form jig 84 is illustrated in place. When the switch plate 100 is thus jigged into place, the screw holes 96 and 98 of plate 100 are aligned with screw holes 92 and 94 of card 90 as well as with the cavities 62 and 64 and the molten wax-like material in the cavities. It will be appreciated that by proper selection of wax-like material as to heat conducting properties, viscosity, melting point and similar factors that the material will start to harden into the shape of its containing cavity almost as soon as it is deposited into the cavity. The cooling is greatest at the metal surfaces which define the cavity and the material starts to acquire its shape almost as soon as it is deposited in the cavity when the proper combination of factors governing the wax-like composition have been selected. The top of the composition does not have a chance to solidify before the card is put in place and so there is a wetting of the card by the composition and a resultant adherence of the card to the composition.

Figure 13:
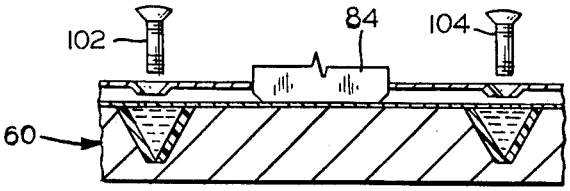
FIG. 13 is a similar schematic view with screws poised for entry through the article.

Also, the center of the composition is the slowest to solidify and this permits a screw to be easily inserted with finger pressure into place in the molten composition. In FIG. 13 the assembly of FIG. 12 is illustrated with the screws 102 and 104 poised for insertion through the screw openings in the switch plate 100, the screw openings in card 90 and into the molten composition in cavities 62 and 64.

Figure 14:
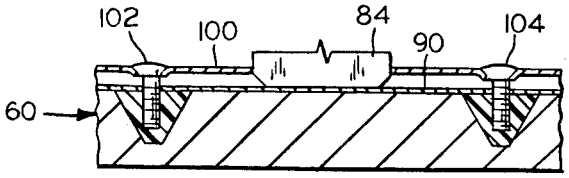
FIG. 14 is a similar schematic view of the assembled packaged article with the screws in place.

The screws 102 and 104 are easily inserted into place as illustrated in FIG. 14 by finger pressure as indicated above. By this time, the outer portion of the composition will have given up its heat to platform 60. Platform 60 is preferably a metal plate to facilitate receipt of heat from the composition. Also, the composition overflowing the cavity and sandwiched in a thin layer such as 54 or 56 of FIG. 4 between the metal platform and card adheres to the card. Accordingly, an outer envelope of solidified composition is bonded to the card and the entire composition is removed from the cavities of the platform as the card is removed from the platform.

Separation of the completed packaged article is the last step of the process.

From the foregoing, it is evident that a unique packaged article and method of forming the packaged article is taught. It will be understood that the article claimed is not limited to any specific wall plate or similar article, but includes as well any article sold mounted to a card and supplied with a mounting screw.

What is claimed as novel and sought to be protected by Letters Patent of the United States is the following:

1. A packaged article comprising, an article having at least one screw hole and a screw extending through the hole, a card package in contact with and extending beyond at least one surface of the article, each said screw extending through a hole in the card aligned with said hole in the article, a plastic sheath in the form of a tapered nut aligned with each said screw hole in said card and bonded to the surface of said card opposite said article, said sheath surrounding the threaded end of said screw.

2. The article of claim 1 in which the card package has an opening in the portion extending beyond the article.

3. The packaged article of claim 1 in which the plastic sheath is of wax.

* * * * *